US005943804A

United States Patent [19]

Linquist et al.

[11] Patent Number: 5,943,804

[45] Date of Patent: Aug. 31, 1999

[54] SLIDABLY FASTENABLE TAG

[75] Inventors: John B. Linquist, Sibley, Iowa; Debra K. Houseman, Fulda; Brian D. Larsen, Worthington, both of Minn.

[73] Assignee: Bedford Industries, Inc., Worthington, Minn.

[21] Appl. No.: 09/014,772

[22] Filed: Jan. 28, 1998

[51] Int. Cl.[6] ..... G09F 23/00

[52] U.S. Cl. ..... 40/637; 40/673

[58] Field of Search ..... 40/310, 331, 637, 40/665, 673, 299.01; D20/22, 27

[56] References Cited

U.S. PATENT DOCUMENTS

| | | | |
|---|---|---|---|
| 2,095,195 | 10/1937 | Macdonald . | |
| 2,205,467 | 6/1940 | Cohen | 40/310 X |
| 2,669,047 | 2/1954 | Rieger . | |
| 4,189,808 | 2/1980 | Brown . | |
| 4,197,984 | 4/1980 | Hartman et al. | 40/310 X |
| 4,357,740 | 11/1982 | Brown . | |
| 4,914,789 | 4/1990 | Pedersen . | |
| 5,390,435 | 2/1995 | Grody | 40/310 |
| 5,404,621 | 4/1995 | Heinke . | |
| 5,697,177 | 12/1997 | Ludlow et al. | 40/665 |

FOREIGN PATENT DOCUMENTS

| | | | |
|---|---|---|---|
| 2227591 | 8/1990 | United Kingdom | 40/310 |

*Primary Examiner*—Brian K. Green
*Attorney, Agent, or Firm*—R. C. Baker & Associates, Ltd.

[57] ABSTRACT

The marking tag for quick and easy slidable fastening on a stalk of merchandise consists essentially of a flat sheet of highly flexible and easily crushed and distorted plastic material having a thickness between 7 and 14 mils and having an information portion for printed matter and a stalk-receiving portion for affixation to a stalk of merchandise. The stalk-receiving portion has a single circular hole between 5 and 10 mm in diameter and surrounded by at least 10 radial slits equidistantly spaced about the hole and having a radial length about equal to the diameter of the hole. The long and narrow and blunt radial fingers so formed are so highly flexible as to readily curve out of the flat plane of the sheet material as the hole is slid onto merchandise, and all edges of the marking tag are incapable of causing a paper cut to a person affixing it and incapable of causing cutting or gouging action to the merchandise, regardless of how the marking tag is slid or rotated on or off the stalk.

10 Claims, 1 Drawing Sheet

SLIDABLY FASTENABLE TAG

BACKGROUND OF THE INVENTION

This invention relates to a slidably fastenable marking tag and more particularly to a marking tag for quick and easy slide fastening on merchandise and quick and easy removal from the merchandise without causing damage to the merchandise.

It is not just merchandise quality but also the uniqueness of markings that creates attention for customer perusal and selection for purchase. Uniqueness of marking is best created by a marking tag designed for a product, and the greater the likelihood that the marking tag is wedded to the nature of the product, or vice versa, the greater the probability is that a consumer will consider it unique and be attracted to the tagged product, even if curiosity is the dominant factor causing the attraction.

Few items of merchandise present more confounding problems for reliable attention-getting marking and attractive bag-free display than clumps of celery. A first requirement is that the bag-free clumps have to be maintained in a moist condition, and that generally requires water sprays, which means that the marking tags for celery have to be resistant to moisture. Next, the marking tags should avoid damage to the celery. Tags fixed by banding about a celery clump generally tend to bruise portions of the stalks of celery. Adhesively affixed stickers or tags, while they can avoid damage, are generally unreliable because they tend to fall off the moist celery stalks in display bins or shelves.

Special attention also has to be given to tagging in a manner to allow displayed bag-free celery clumps to be easily freshened (such as by tearing off wilted leaves or the like, or even breaking off wilted stalks that have not received sufficient moisture). Such freshening steps are most desirably accomplished without removing or replacing tags.

Although bag-free celery presents one of the more vexing problems of appropriate tagging in an economical manner, there are other types of growing or grown products that have features approaching those of celery (e.g., anything having arms or stalks somewhat resembling celery stalks, including trees or shrubs).

In most instances, reliable marking of produce with speed and ease means that hand affixation of the marking tags is required, which in turn can put workers at risk of injury or damage (as by paper cuts) unless the marking tags are made to avoid such risks.

The merit of this invention is that it overcomes or avoids problems such as aforenoted and nevertheless provides a unique and exceedingly simple solution to the tagging of bag-free celery as well as any other stalk-type merchandise.

SUMMARY OF THE INVENTION

The invention provides a new marking tag that is quickly and easily fastened by sliding it on a stalk of merchandise. The tag is also quickly and easily slid off or removed from the stalk without damage to the stalk.

The new marking tag consists essentially of a flat sheet of highly flexible and easily crushed and easily distorted plastic material that slowly recovers from distortion. The sheet has a thickness between about 7 and 14 mils and has an information portion carrying printed matter and a stalk-receiving portion equipped with a single circular hole. The single circular hole extends through the sheet and has a diameter between 5 and 10 mm. This hole is surrounded by at least 10 radial slits extending through the sheet and equidistantly spaced from each other. Further, the slits have a radial length approximately equal to the diameter of the circular hole. This radial length extends out from the circular hole in a radial direction. The structure is such as to form at least 10 long and narrow radial fingers about the hole. Each finger has a blunt, substantially flat inward end no greater in circumferential width than 36 degrees. Further, each finger is so long and so narrow and so highly flexible as to be readily curved out of the flat plane of the sheet material as the hole is slid on a merchandise stalk having an overall diameter size between about 110 and 190 percent of the diameter of the hole. The external perimeter edges of the sheet and the internal finger edges of the sheet are so smooth and yieldable on contact with anything that all of those edges are incapable of causing a paper cut to a person handling the marking tag and incapable of causing any cutting or gouging action into merchandise such as agricultural produce regardless of how the hole of the marking tag is slid on or off or rotated on or off a stalk of such produce.

The ideal marking tag of the invention has a diameter of approximately 6 mm for its circular hole and has radial slits extending approximately 6 mm outward from the circumference of the circular hole. It is formed of a sheet of polyolefin plastic having a thickness of about 8 to about 12 mils.

Further advantageous features and benefits of the invention will become evident as this description proceeds.

DESCRIPTION OF THE PREFERRED EMBODIMENT(S)

Figure 1:
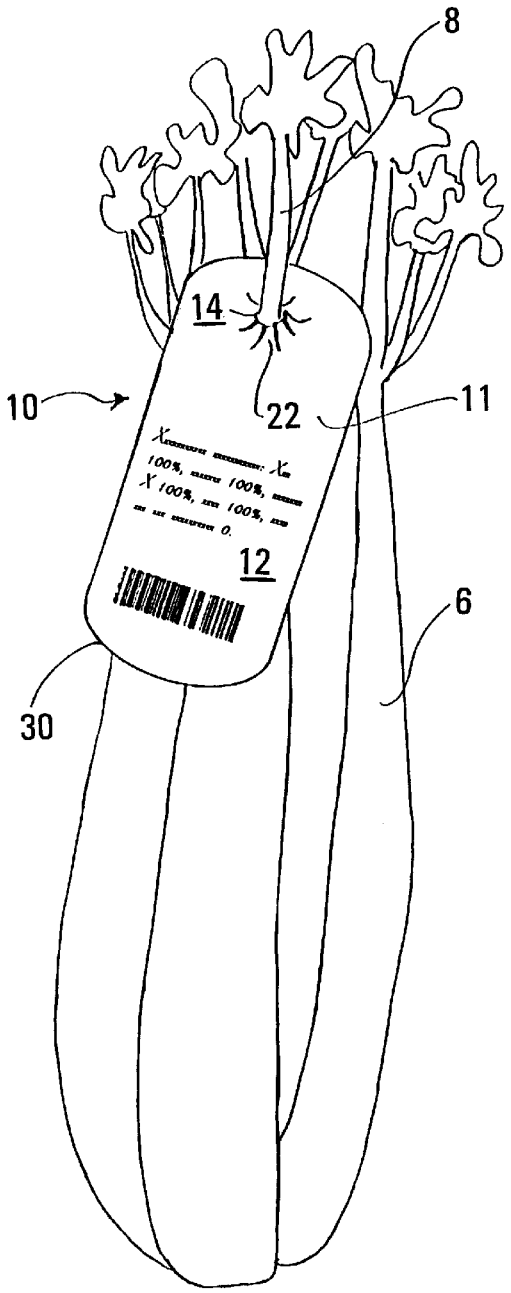
FIG. 1 is a schematic perspective view of a clump of celery, with parts broken away, illustrating the new marking tag of the invention on a single stalk of the clump.
Figure 2:
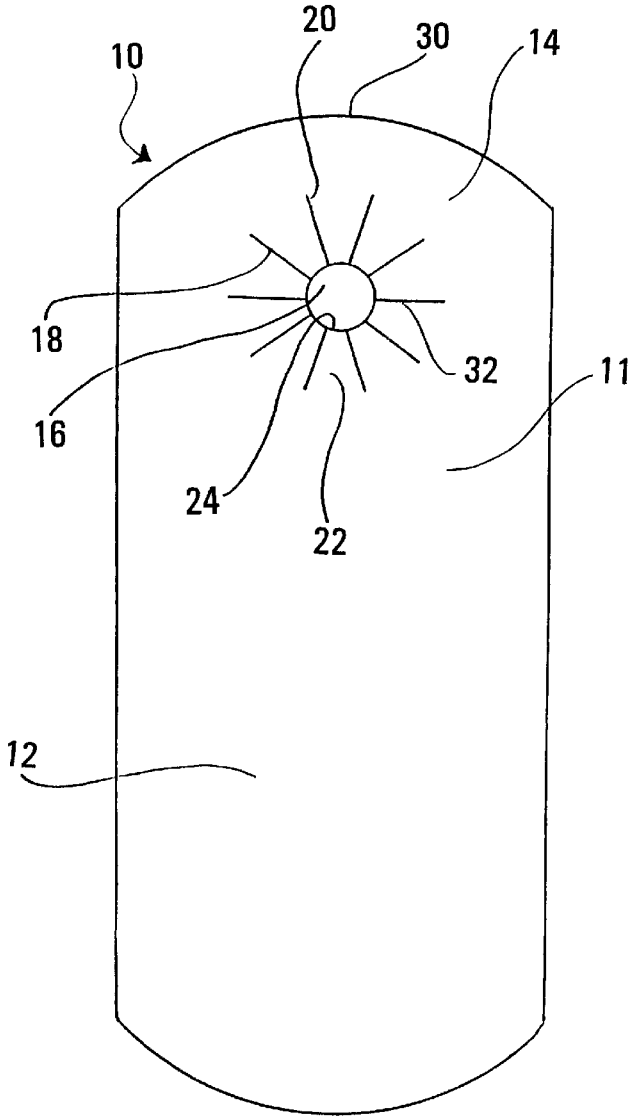
FIG. 2 is a schematic plan view of the new marking tag of the invention.

Referring to the drawing, the marking tag 10 is on a stalk 8 of a clump 6 of celery. The tag consists essentially of a flat sheet 11 of highly flexible and easily crushed and distorted and wrinkled plastic material. Although the flat sheet can slowly recover from distortion, it is not at all in the nature of an elastomeric or resilient-type sheet. It behaves more like a sheet of kidskin leather, although it is not quite as flimsy as kidskin leather. It has a thickness between about 7 and 14 mils (i.e., between about 0.003 and 0.014 in.). Preferably the thickness of the sheet from about 8 to about 12 mils.

The flat sheet has an information portion 12 carrying printed matter and a stalk-receiving portion 14. The printed matter 13 suitably may include any explanatory information dealing with the merchandise or the producer or source of it, any trademarks or names, the common generic name for the product, the PLU number, any bar or UPC code (whether optical, magnetic or other readable code), suggestions for preserving the product, nutritional information, recipes, and any other printed information for creating a desired impression on a potential consumer.

The stalk-receiving portion has a single circular hole 16 of a diameter between 5 and 10 mm, and this hole extends through the sheet. The hole is surrounded by at least 10 radial slits 18. These slits 18 extend completely through the sheet and are equidistantly spaced from each other about the hole. Further, the slits have a radial length 20 outward from the circular hole that is at least approximately equal to the diameter of the hole. Thus, at least 10 long and narrow radial fingers 22 are formed about the circular hole, each having a blunt, substantially flat inward end 24 (i.e., an essentially straight or flat end at the circumference portion of the hole). The narrowness of the fingers at their inner end makes the inner ends 24 essentially flat or straight despite the fact that they make up the curved circumference of the hole 16. The flat inward end of these fingers has a circumferential width no greater than 36 degrees. Each finger is so long and so narrow and so highly flexible as to readily curve out of (i.e., be easily pushed out from) the flat plane of the sheet material as the hole 16 is slid on a merchandise stalk such as a stalk of celery having an overall diameter size between about 110 and 190 percent of the diameter of the circular hole 16.

A critical feature of the sheet 11 is that its external perimeter edges 30 and its internal finger edges 32 (i.e., the substantially flat inward ends 24 as well as the cut side edges 18 of each finger 22) are so smooth and yieldable on contact with anything that all of those edges are incapable of causing a paper cut to a person handling the marking tag. Further, the edges are incapable of causing any cutting or gouging action into merchandise such as agricultural produce, regardless of how the circular hole of the marking tag is slid or rotated on or off a stalk of the produce.

Ideal plastic sheets for the new tag are from the polyolefin family. An extremely broad variety of polyolefin-type plastic materials may be employed. Two important characteristics for the plastic sheet are that it must be water resistant and also printable. In this respect, printable sheets of various types may be employed and covered with plastic film to protect the same and maintain water resistance. Such sheets are in essence plastic, and therefore are not disintegrated when placed in water or subjected to moisture sprays. Polyolefinic thermoplastics such as polymers of ethylene and polypropylene are by far the most preferred plastics to employ in forming the sheets for the invention. A polyolefin thermoplastic printable sheet material behaving in an ideal manner for practice of the invention is that available commercially under the trademark TESLIN from PPG Industries of Pittsburgh, Pa. In addition to printability and resistance to deterioration from moisture, the plastic sheet should exhibit certain other specialized properties readily exhibited by plastic sheets of the polyolefin called TESLIN at the thickness range discussed herein.

A notable characteristic of preferred polyolefin plastic sheets for practicing the invention is that, at the thicknesses required, namely between about 7 and 14 mils, they approach but do not exhibit a flimsy or limp characteristic. In other words, while the sheets are so very thin as to be easily folded and easily wrinkled, they do exhibit a tendency toward slowly recovering from a distorted or wrinkled or crushed condition. Still further, they exhibit a tendency of not drooping more than about 30 degrees downward from the horizontal when a 5 in. length of the sheet is held at one end so that the sheet is substantially in a horizontal position but with the non-held end cantilevered out from the end held between one's fingers.

Interestingly, polyolefin sheets for practicing the invention behave much like ordinary photocopying paper, but are quite different in that it is impossible to get a paper cut from the marking tags of the invention. External perimeter edges 30, as well as all internal finger edges (e.g., at the inward end of the fingers as well as along the sides of the fingers formed by the cuts or slits 18) are all so smooth and yieldable and even somewhat stretchable that any body or finger contacting the edge only causes the edge to yield or easily bend but never penetrate whatever is slid along the edge. This is critically important for handling purposes since the tags of the invention are, in almost all instances, affixed and removed by hand. Part of the reason hand-affixation is required is because agricultural merchandise such as clumps of celery is not of uniform nature. A further benefit from this yieldability characteristic is the fact that the ultimate consumer, on removal of a tag of the invention, is never confronted with any serious risk of a paper cut and never confronted with any serious risk that the produce such as celery will be cut or scarred on removal of a tag. Even the most careless of removals is not apt to cause any significant or noticeable damage to the produce.

A critical feature of the invention is the multiplicity of narrow radial fingers projecting inwardly to the circular stalk-receiving hole. At least 10 such narrow fingers and even as many as 16 are needed to exhibit the needed property for gentle produce marking without suffering damage even when rather extremely fast affixation of the tag on a stalk is performed (a speed that may approach the appearance of careless affixation). Avoidance of produce damage is getting more and more attention, not just to avoid financial loss, but importantly, to satisfy consumer quality demands. The multiplicity of narrow radial fingers in the thin plastic sheeting makes each finger too weak to exhibit the body strength to bruise or cut or scar or gouge a stalk of celery or the like as the new tag of the invention is slid or rotated on and slid or rotated off the stalk. But more than 16 of the slender narrow radial fingers are unnecessary and only increase the expense of manufacturing the tag.

It is also important to the practice of the invention that the inner ends of the radial fingers are not pointed. Pointed inner ends tend to dig into or gouge a stalk, especially at times when a tag—after being affixed on a stalk and hanging so that its information portion carrying printed matter is about parallel to the stalk—is flipped (i.e., turned over) to read printed matter on the reverse side of the information portion. Blunt finger tips as taught herein exhibit essentially no tendency toward gouging a stalk as the information portion 12 is flipped from a substantially parallel location along the length of the stalk 8 below the stalk-receiving hole to a location substantially parallel with the length of the stalk above the stalk-receiving hole (as opposing sides of the information portion are read by a consumer). Thus, to a significant extent, the tags of the invention can be considered "gentle," in that they do not damage produce. The overall size of the tags may vary from about 1 in. in width and 2 in. in length up to as much as about 2½ in. in width (or even 5 in. in width) and about 5 in. or so in length, with a stalk-receiving portion possibly limited to the corner or a curved bulge of the tag and the information portion always dominating the tag in terms of area. Thus, the information portion is more extensive in area than the relatively limited area required for the stalk-receiving portion. The ideal tag size is approximately 1½ in. in width and approximately 3½ in. in length.

The invention accordingly provides an exceedingly economical and strikingly unique marking tag for stalk-type produce. This tag avoids damage to the produce, is easily and extremely quickly affixed to the produce, retains its affixation on the produce even when handled and shifted about under marketplace conditions, and yet is exceedingly easy to remove from the produce without risking damage to the produce.

That which is claimed is:

1. A flat marking tag for quick and easy slide fastening on a stalk of grown or growing merchandise requiring water to maintain freshness, and for quick and easy slide removal from the stalk without damage to the stalk, said flat marking tag consisting of a flat sheet of highly flexible and easily crushed and easily distorted and easily wrinkled water-resistant and printable plastic sheet material that slowly recovers from crushing and distortion and wrinkling and has a thickness between about 7 and 14 mils, said flat sheet being in a flat plane and having an information portion carrying printed matter and a stalk-receiving portion, said stalk-receiving portion having a single circular hole of a diameter between 5 and 10 mm through said flat sheet, said hole being surrounded by at least 10 radial slits through said flat sheet equidistantly spaced from each other and having a radial length outward from the circumference of said circular hole approximately equal to the diameter of said hole, thereby to form at least 10 long and narrow radial fingers, each of said fingers having a blunt substantially flat inward end no greater in circumferential width than 36 degrees, each said finger being so long and so narrow and so highly flexible as to readily curve out of the flat plane of said flat sheet when said hole is slid on a merchandise stalk having an overall diameter size between about 110 and 190 percent of the diameter of said hole, said flat sheet having external perimeter edges and internal finger edges that are so smooth and yieldable on contact that all said edges are incapable of causing a paper cut to a person handling said flat marking tag and incapable of causing any cutting or gouging action into grown or growing merchandise requiring water to maintain freshness regardless of how the hole of said flat marking tag is slid or rotated on or off a stalk of merchandise.

2. The tag of claim 1 wherein said flat sheet has a thickness between about 8 and 12 mils.

3. The tag of claim 1 wherein said radial slits exceed 10 in number but are not in excess of 16 in number.

4. The tag of claim 1 wherein said circular hole has a diameter of approximately 6 mm and said radial slits have a length from said circumference of said circular hole of approximately 6 mm.

5. The tag of claim 1 wherein said plastic material comprises a polyolefin.

6. The tag of claim 1 wherein said plastic sheet material comprises a polyethylene.

7. The tag of claim 1 wherein said information portion is more extensive in area than said stalk receiving portion.

8. The tag of claim 1 wherein said flat marking tag when applied to a stalk of merchandise remains substantially flat except for the curves of the fingers of said tag out from the flat plane of said tag.

9. The tag of claim 1 wherein said flat sheet exhibits a tendency of not drooping more than about 30 degrees downward from the horizontal when a 5 in. length of said sheet is held at one end so that said sheet is substantially in a horizontal position but with the non-held end cantilevered out from the end held between one's fingers.

10. A stalk of grown or growing merchandise requiring water to maintain freshness and a marking tag having a stalk receiving portion through which said stalk extends and by which said stalk is embraced, said marking tag being formed from a flat sheet of highly flexible and easily crushed and easily distorted and easily wrinkled water-resistant and printable plastic sheet material that slowly recovers from crushing and distortion and wrinkling and has a thickness between about 7 and 14 mils, said flat sheet being in a flat plane and having an information portion carrying printed matter and said stalk-receiving portion having a single circular hole of a diameter between 5 and 10 mm through said flat sheet, said hole being surrounded by at least 10 radial slits through said flat sheet equidistantly spaced from each other and having a radial length outward from the circumference of said circular hole approximately equal to the diameter of said hole, thereby to form at least 10 long and narrow radial fingers, each of said radial fingers having a blunt substantially flat inward end no greater in circumferential width than 36 degrees, said flat sheet of said marking tag having external perimeter edges and internal finger edges that are so smooth and yieldable on contact that all said edges are incapable of causing a paper cut to a person handling said marking tag and incapable of causing any cutting or gouging action into said merchandise regardless of how said stalk receiving portion embraces or is slid or rotated on or off said stalk, said merchandise stalk having an overall diameter size between about 110 and 190 percent of the diameter of said hole of said stalk receiving portion, and each said radial finger being curved out of the flat plane of said flat sheet by the stalk of said merchandise extending through said hole of said stalk receiving portion.

* * * * *